United States Patent [19]

Piro

[11] 4,084,759

[45] Apr. 18, 1978

[54] METHOD AND A DEVICE FOR WINDING UP A YARN RESERVE

[75] Inventor: Mario Piro, Genoa, Italy

[73] Assignee: Nuova San Giorgio S.p.A., Genoa-Sestri, Italy

[21] Appl. No.: 687,232

[22] Filed: May 17, 1976

[51] Int. Cl.[2] ..... B65H 54/02

[52] U.S. Cl. ..... 242/18 PW; 242/18 DD

[58] Field of Search ..... 242/18 PW, 18 DD, 18 R, 242/18 A, 19

[56] References Cited

U.S. PATENT DOCUMENTS

| | | | |
|---|---|---|---|
| 3,899,140 | 8/1975 | Gleyze | 242/18 PW |
| 3,921,921 | 11/1975 | Katayama et al. | 242/18 PW X |
| 3,952,959 | 4/1976 | Shaw et al. | 242/18 PW |
| 3,974,972 | 8/1976 | Egli et al. | 242/18 PW |

*Primary Examiner*—Stanley N. Gilreath

[57] ABSTRACT

A method for winding up a yarn reserve on a winding tube for a bobbin. The method comprises the steps of: continuously sucking the spun yarn, causing it to move through a circular yarn guide-positioning element, removably arranged coaxially with a yarn suction orifice; removing yarn positioning element from the suction orifice while the yarn being supplied and continuously passing therethrough; positioning said element above a yarn adherence zone of tube; breaking the yarn passing through the positioning element allowing the supplied yarn end to fall down on the tube adherence zone and into guide device, with yarn end facing externally of the tube end, and forming yarn reserve turns before winding the yarn bobbin.

12 Claims, 8 Drawing Figures

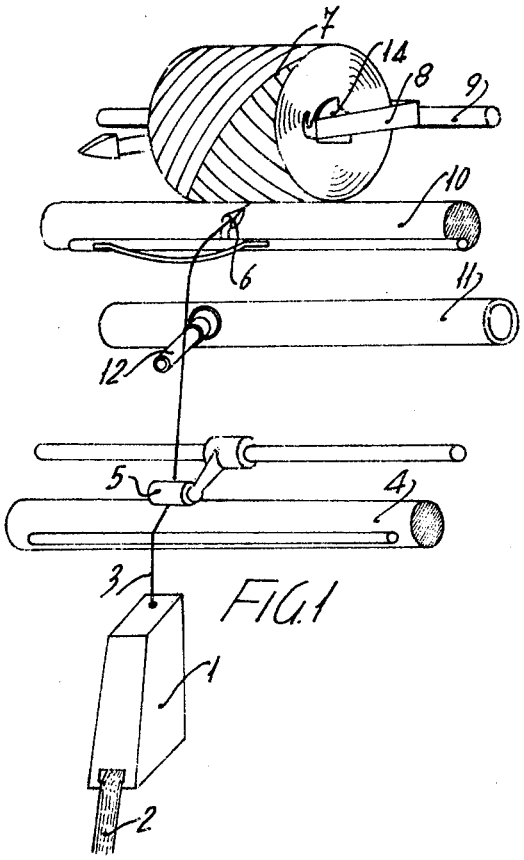
FIG.1
FIG.2
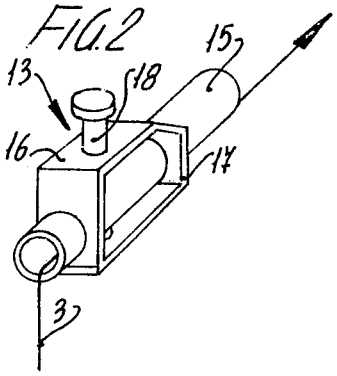
FIG.3
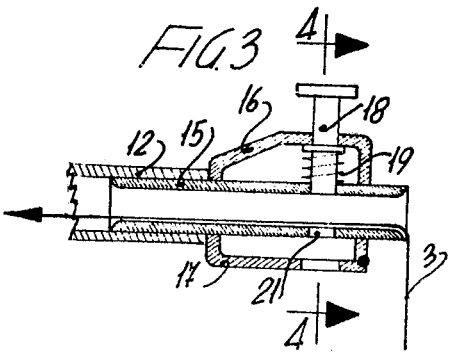
FIG.4
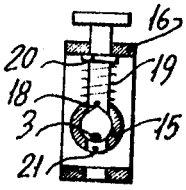

METHOD AND A DEVICE FOR WINDING UP A YARN RESERVE

This invention relates to a method for providing the winding of a yarn reserve on the edge of tubes at the beginning of every yarn bobbin winding.

This invention is also concerned with a device for providing a yarn reserve on a tube in accordance with such a method.

It is known to provide a winding of a yarn reserve on a bobbin tube, in order to connect the end of a bobbin with the beginning of another one, to enable a continuous handling thereof at the processing steps following the spinning operation.

It has already been proposed to form a yarn reserve at the beginning of a bobbin winding on Open End type of spinning machines. In such types of spinning machines, the yarn being continuously produced and withdrawn from a spinning unit, it wound up to form a bobbin on a winding tube, which is rotably carried by swinging arms and bears against a driving cylinder.

Several devices have been proposed for automatically or semi-automatically providing a yarn reserve directly on Open End spinning machines at the beginning of a bobbin winding.

Such known devices have several disadvantages. Particularly, the automatic devices known at present are not consistent with bobbins take off systems used at present. Moreover, such automatic devices (and also known semi-automatic devices), in addition to involving high costs, do not ensure a perfect formation of the yarn reserve, because of the difficulty in gripping the end or origin of the turns of the reserve yarn which generally remain covered by the turns of said yarn reserve.

On the other hand, known semiautomatic devices have proved to be hard to use, as not allowing a reliable control on the running yarn.

Additionally, both automatic and semi-automatic devices for providing a yarn reserve in Open End type of spinning machines provide a yarn reserve with sufficiently tightly wound turns on the tube. Therefore, there arises the risk that, either during the bobbin winding or in the subsequent handlings, the turns of reserve yarn will unwind from the tube, thus getting entangled or interferring with moving members.

Therefore, this invention is directed to a method and a semiautomatic device for forming a yarn reserve at the beginning of a bobbin winding in an Open End type of spinning machine, without discontinuing the operation of the spinning units, to allow for a simple and convenient control of the yarn, which yarn freely runs in an annular or tubular guide element of a manual yarn positioning device used for leading the yarn on the winding tube. Therefore, according to the invention, unlike all of the other known systems, the yarn is completely encircled by the annular guide element of the yarn positioning device and runs internally of said positioning device, so that a less amount of care and concentration is required from an operator in carrying out the yarn reserve operations.

It is a further object of the present invention to provide a method and device for the formation of a yarn reserve, so as to maintain the yarn origin or end at the outside of tube and uncovered by the reserve yarn turns being successively wound up.

It is a further object of the present invention to provide a yarn reserve forming device, wherein a yarn guide element, arranged on a supporting arm of the reel, is capable of accomodating and automatically guiding the yarn during reserve winding, imparting a constant tension to the yarn in the length between said guide element and the reserve turns being wound up on the tube.

Generally in, a method according to the invention for winding up a yarn reserve on a winding tube for a bobbin, said tube having a side yarn adherence zone and which tube is rotably driven by a driving cylinder in which, during bobbin doffing, the yarn — as continuously produced by an Open End spinning unit — is sucked by a suction orifice, which comprises the steps of: continuously sucking the spun yarn, causing it to move through a circular yarn guide-positioning element, romovably arranged coaxially with the suction orifice; removing the yarn positioning element from the suction orifice, while the yarn being supplied and continuously passing therethrough; positioning said element above the yarn adherence zone of tube; breaking the yarn passing through the positioning element; allowing the supplied yarn end to fall down on the tube adherence zone and into a guide device, with the yarn end facing externally of the tube end; and forming yarn reserve turns before winding the yarn bobbin.

Correspondingly, the yarn reserve forming device according to the invention consists of a manual positioning element comprising a yarn guide element having circular crosssection, such as tubular or annular shape, which can be removably arranged at an orifice of a yarn suction channel, said positioning element being provided with a yarn cutting device and a yarn guide device carried at the end of a supporting arm for a yarn winding tube.

A preferred embodiment of the invention will now be described with reference to the accompanying drawings, in which:

FIG. 1 is a view schematically showing a spinning unit in an Open End type of spinning machine, as a yarn bobbin is being wound up;

FIG. 2 is a perspective view of the yarn positioning element;

FIG. 3 is a longitudinal sectional view of the positioning element;

FIG. 4 is a cross-sectional view taken along line 4—4 of FIG. 3;

Figure 5:
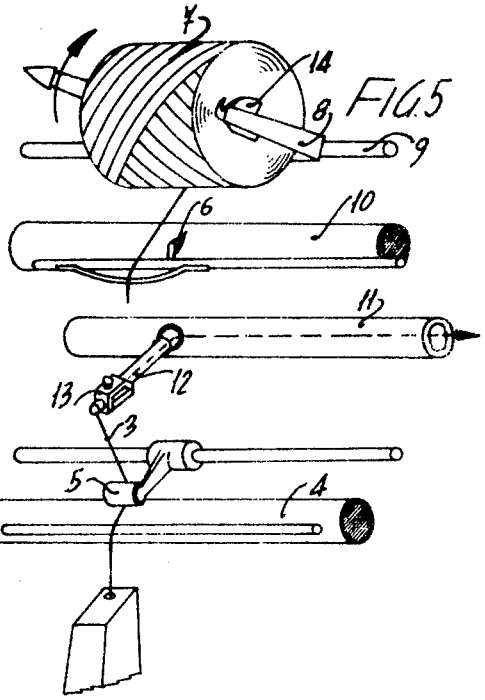
FIG. 5 is a view similar to that of FIG. 1, but showing the doffing step.
Figure 6:
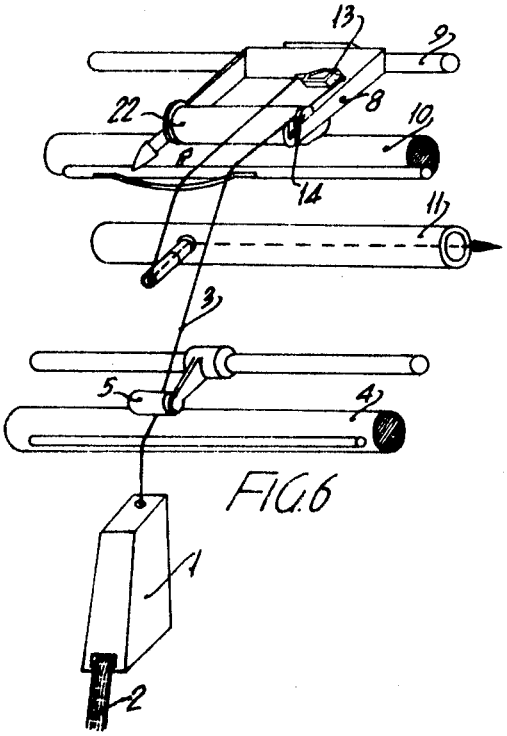
FIG. 6 is a view similar to that of FIG. 1; but showing the beginning of the yarn reserve forming step on a new tube.

FIG. 1 schematically shows a processing station in an Open End type of spinning machine, comprising a spinning unit 1, to which a sliver 2 of discontinuous fibers is fed and from which a continuous yarn 3 is removed. In a per se known manner, yarn 3 is removed by means of a withdrawing cylinder 4 and a pressure roller 5 to be moved upwardly to a distributing device 6 providing for distributing the yarn on a bobbin 7. Bobbin 7 is wound up on a tube (not shown in FIG. 1) carried by a pair of swinging arms 8 pivoted, for example, to a longitudinal bar 9 of the spinning machine, said bobbin 7 being rotably driven by an underlyind winding cylinder 10.

Longitudinally of the spinning machine there is a suction conduit 11 which at each of the spinning unit has a small tube 12 with a suction orifice for sucking the yarn being continuously produced by spinning unit 1 during doffing of bobbin 7, and before a yarn reserve is formed on a new tube, as clearly hereinafter understood.

According to the invention, to form a yarn reserve, a device is provided as comprising a positioning element, designated as a whole at 13, which is manually operable and shown in FIGS. 2 through 4 of the accompanying drawings, and a fixed yarn guide device 14 carried at the end of one of the supporting arms 8 for the bobbin winding tube.

Referring now to FIGS. 2, 3 and 4, a practical embodiment of said yarn positioning element 13 will be described. As shown in said figures, a yarn positioning element substantially comprises a yarn guide of circular cross-section, such as a tubular element 15, the inner surface of which has been machined to mirror-like smoothness in order to minimize sliding friction of yarn 3.

Tubular element 15 has an outer diameter which is slightly less than the inner diameter of suction tube 12, so that guide element 15 can be removably threaded into suction tube 12, as shown in FIGS. 3 and 5 of the accompanying drawings, to make up an extension of said suction tube. Otherwise, guide element 15 could have a larger diameter than that of suction tube 12 to be completely placed on the latter. In both cases, the arrangement is such that the yarn sucked from tube 12, as better explained in the following, passes through the circular yarn guide element of the positioning device.

In the example shown, tubular element 15 is carried by a handle 16 having, at one end, a flat surface 17 for making a sealing against the orifice of suction tube 12.

The positioning device is further provided with a yarn cutting device, for example comprising a peg 18 guided by handle 16 perpendicularly to the axis of yarn guiding element 15. Said peg 18 is urged by a spring 19 arranged about the peg and bearing with one end thereof against said tubular element 15, while bearing with its other end against a stop ring 20 applied to peg 18.

The lower end of peg 18 penetrates tubular element 15 through aligned holes and has a cutting edge with a V-shaped groove arranged transversely of the tube axis. The edge of the peg cooperates in cutting the yarn, with the edge of the hole 21 in tubular element 15, as shown in the sectional view of FIG. 4. As mentioned above, the yarn reserve forming device further comprises a fixed yarn guide device, indicated as a whole at 14 and more particularly shown in the views of FIGS. 7 and 8.

Such a yarn guide device is carried by the end of a supporting arm 8 for a bobbin winding tube 22, said tube having an end yarn adherence zone 22' for yarn reserve formation. For instance, this Zone 22' may comprise a roughened surface of tube 22.

Figure 8:
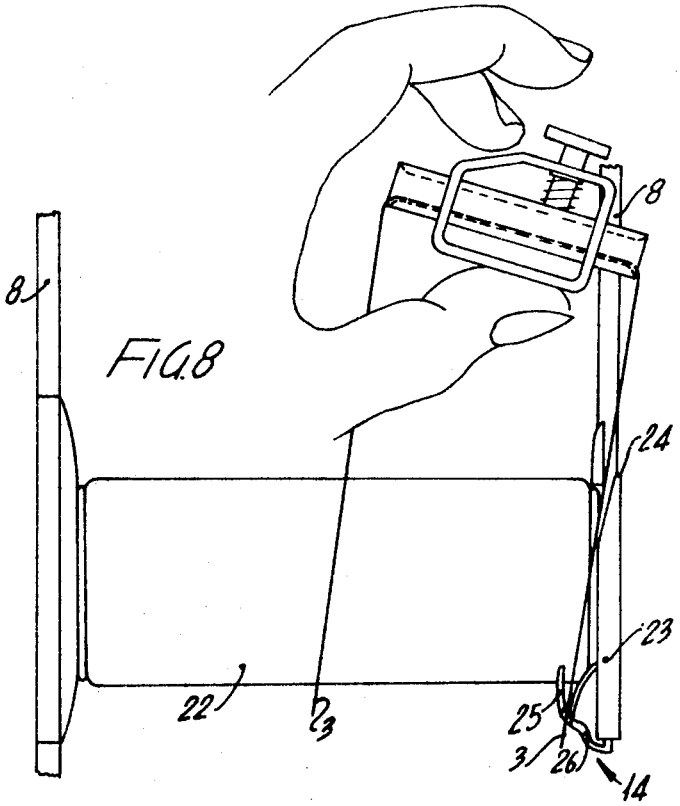
FIG. 8 is a fragmentary enlarged top plan view of FIG. 6.

Guide device 14 comprises a disc 23 having, rearwardly of the tube axis, a radial edge 24 upward facing and suitably chamfered on the inside, as shown in FIG. 8, for allowing an outward skew arrangement for yarn 3 supplied for spinning unit 1 relative to the axis of tube 22, as shown in plane view of FIG. 8.

On the internal side, that is on the side facing tube 22, said disc 23 has a shaped plate 25 with an upward facing V-shaped groove 26 for yarn guide; groove 26 has arcuate edges, and is formed in a curved intermediate zone of plate 25. Plate 25 with yarn guide groove 26 is arranged laterally of the disc 23 and, at the forward position, is aligned with yarn adherence zone 22' of the tube 22. Said guide groove 26 upward opens, so that yarn 3 can be positioned from above and guided on the bottom of groove 26.

Figure 7:
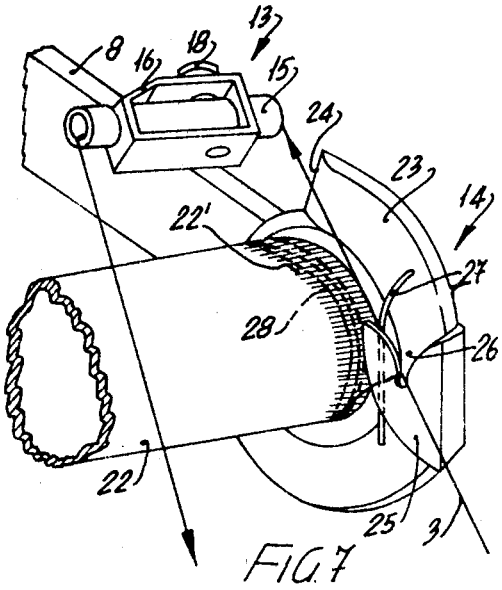
FIG. 7 is an enlarged perspective view of FIG. 6, as seen from the inside.

Following said V-groove and on its side facing yarn guide plate 25, yarn guide device 14 is also provided with a resilient element or friction spring 27 for imparting the correct winding tension to yarn 3 as yarn reserve 28 is being formed on tube 22, as schematically shown by dashed lines in FIG. 7.

Pressure of spring 27 should not be high or such as to damage the yarn, but should be sufficient to impart to the yarn a constant tension between guide element 14 and tube 22 for preventing the turns of yarn reserve 28 from becoming unwound during subsequent formation or handling of the bobbin. Spring 27 may comprise a wire made of metal, nylon or other suitable material and is attached at one end thereof to the edge of dics 23, downward facing against plate 25, forming with the latter a passage restricting downward and through which the yarn can wedge itself in.

The yarn reserve is formed as hereinafter described with reference to FIGS. 5, 6, 7 and 8 of the accompanying drawings.

After completing winding of a yarn bobbin 7, positioning element 13 is placed within the orifice of tube 12 and then the yarn is manually broken. The yarn, which is continuously withdrown from spinning unit 1, is now sucked by suction tube 12 through tubular guide 15 of the positioning element.

Then, in a per se known manner, bobbin 7 is doffed and replaced by a new empty tube 22. As doffing operation is being carried out, yarn 3 produced by spinning unit 1 continues to be sucked through yarn guide 15 of positioning element 13.

After an empty tube 22 has been applied between supporting arms 8, the latter are lowered and tube 22 is brought to adhere against driving cylinder 10 and rotably driven thereby. Then, positioning element 13 is removed from suction orifice 12 and manually moved to above the tube with yarn 3, forming a loop between said spinning unit 1 and suction orifice 12, as clearly shown in FIG. 6.

With such an arrangement of the positioning element, yarn 3 continues to be sucked in conduit 11, always running within tubular guide 15 of said positioning element, substantially without any risk that the yarn might slip out, because of being substantially encircled or enclosed by tubular guide 15. Therefore, an operator can operate completely free of any troubles.

After moving yarn 3 with positioning element 13 to above tube 22, such a positioning element is arranged rearwardly and laterally of tube 22, so that the run of yarn 3 from the spinning unit is shewed and oriented outwardly of the tube, above guide plate 25 in the adherence zone 22' for the yarn of tube 22. This condition is clearly shown in FIGS. 7 and 8 of the accompanying drawings.

Now, the cutting means of positioning element 13 are acted upon by downward urging peg 18, so that yarn 3 is cut. Therefore, the yarn portion previously introduced into tube 12 is completely sucked, while the new head or origin of yarn 3 falls down from the top on the tube adherence zone 22' and, as guided by groove of plate 25, starts to wind up on tube 22. As the turns of the yarn reserve are being formed, spring 27 acts against the yarn imparting thereto a correct tension.

The correct shew arrangement initially given to the yarn, relative to the tube axis, due to the provision of chamfered edge 24 of disc 23, will prevent the yarn head or origin from being covered by the yarn turns, thus allowing for a safe and clean subsequent removal of the yarn reserve. Once the desired number of reserve turns has been completed, the yarn is manually extracted from groove 26 of the guide device and supplied to distributing device 6 for bobbin winding operation.

Thus, positioning element 13 can be stored or reused for forming a reserve winding in another spinning unit of the spinning machine.

What is claimed is:

1. A method of winding up a yarn reserve from an open-end spinning unit on a winding tube for a bobbin, wherein the winding tube includes a yarn adherence zone at one end of the tube and wherein the tube is rotatably driven, and wherein during the step of bobbin doffing yarn which is continuously produced by the spinning unit is drawn by suction into an orifice, the method comprising the steps of: continuously applying a suction force to the yarn exiting from the spinning unit to draw the yarn into the orifice, providing a yarn guide positioning element with a yarn guide carried thereby, disposing the yarn guide positioning element with the yarn guide in alignment with the orifice and with the yarn guide in the path of the yarn being drawn into the orifice by the suction force so that the yarn being drawn by the suction force applied thereto is drawn into engagement with the yarn guide before it is drawn into the orifice, removing the yarn guide positioning element from alignment with respect to the orifice while the yarn is being continuously drawn from the spinning unit into the orifice and while the yarn is being drawn into engagement with the yarn guide, positioning the yarn guide positioning element so that the yarn guide orients the yarn engaged thereby above the yarn adherence zone of the tube and in a predetermined orientation with respect to a yarn guide device associated with the tube, breaking the yarn which is engaged by the yarn guide and allowing a portion of the yarn to engage the yarn adherence zone of the tube while an end portion of the yarn disposed axially outward of an end of the tube engages the yarn guide device, and forming yarn reserve turns before winding the yarn about the bobbin.

2. A method as defined in claim 1 including the step of constantly applying a predetermined tension force on the yarn being engaged by the yarn guide device and forming the yarn reserve turns being wound on the tube.

3. A method as defined in claim 1 wherein the step of aligning the yarn guide with the orifice includes the step of disposing the yarn guide in juxtaposition with the orifice to form the yarn guide into a continuation of the orifice.

4. In apparatus for winding a yarn reserve from an open-end spinning unit on a winding tube for a bobbin, wherein the tube is rotatably driven and includes a yarn adherence zone at one end thereof and wherein during the doffing of the bobbin the yarn continuously produced by the spinning unit is drawn by suction into an orifice, the improvement comprising a yarn guide positioning element having a yarn guide carried thereby, means for removably positioning the yarn guide positioning element with respect to said orifice with the yarn guide in alignment with the orifice and with the yarn guide disposed in the path of yarn being drawn into the orifice by the suction so that yarn being drawn by suction into the orifice is engaged by the yarn guide, suction means for continually drawing yarn into engagement with the yarn guide while the yarn guide is in alignment with the orifice, said yarn guide defining means for engaging and guiding yarn which is being drawn into the orifice when the yarn guide is aligned with the orifice and when the yarn guide is removed from alignment with said orifice for guiding yarn above the yarn adherence zone of the tube while the yarn is being drawn by suction into the orifice, a guide device associated with said bobbin, said guide device disposed for engagement with a portion of the yarn being guided by said yarn guide when said yarn guide is disposed above the yarn adherence zone of the tube, means for breaking the yarn engaging the yarn guide while the yarn is disposed above the yarn adherence zone of the tube to allow a portion of the yarn to engage the adherence zone of the tube and to allow an end portion of the yarn extending axially outward of the tube to engage said guide device, and means forming yarn reserve turns before winding the yarn bobbin.

5. In apparatus as defined in claim 4 wherein said yarn guide defines a circular cross sectioned yarn guide surface, said yarn positioning element further including a yarn cutting device, wherein the apparatus includes a support arm arm for the bobbin tube and wherein said yarn guide device is supported at an end of the support arm.

6. In apparatus as defined in claim 5 including means for applying a tensioning force to yarn disposed in engagement with said yarn guide device.

7. In apparatus as defined in claim 5 wherein said yarn positioning element includes a tubular yarn guide element.

8. In apparatus as defined in claim 7 wherein said yarn positioning element includes a peg member moveable perpendicular to said tubular guide between a retracted position on a yarn cutting position, said peg member being guided for movement by a pair of oppositely disposed holes in said guide and including means for cutting yarn as said peg is moved to said yarn cutting position.

9. In apparatus as defined in claim 8 wherein said yarn positioning element includes a handle, and wherein said peg includes a portion extending through said handle, spring means for biasing said peg toward said retracted position.

10. In apparatus as defined in claim 5 wherein said yarn guide device comprises a disc connected with a tube supporting arm and having a portion axially spaced from one axial end of said tube, said disc including having a face portion extending generally radially to said axis, a plate connected with said disc and facing said one axial end of said tube, said plate defining a V-shaped yarn guide groove opening upwardly and being aligned with the adherence zone for yarn on the tube.

11. In apparatus as defined in claim 10 wherein said radial edge of said disc includes a chamfered portion.

12. In apparatus as defined in claim 10 including a yarn tensioning element including a resilient wire attached to said disc and being resiliently urged against the plate and defining a yarn passage therewith.

* * * * *